US007264283B2

(12) United States Patent
Stoof et al.

(10) Patent No.: US 7,264,283 B2
(45) Date of Patent: Sep. 4, 2007

(54) VEHICLE LATCH WITH PARTIALLY DECOUPLED KEY CYLINDER LEVER

(75) Inventors: Frank Stoof, Keswick (CA); Roman Cetnar, Newmarket (CA)

(73) Assignee: Intier Automotive Closures Inc., Newmarket, Ontario (CA)

( * ) Notice: Subject to any disclaimer, the term of this patent is extended or adjusted under 35 U.S.C. 154(b) by 224 days.

(21) Appl. No.: 11/007,946

(22) Filed: Dec. 9, 2004

(65) Prior Publication Data

US 2005/0140148 A1 Jun. 30, 2005

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS 3,592,496 A 7/1971 Ploughman
3,614,146 A 10/1971 Marx
3,679,251 A 7/1972 Brockman et al.
4,756,563 A 7/1988 Garwood et al.
4,969,673 A 11/1990 Portelli et al.
5,028,084 A * 7/1991 Fukumoto et al. ..... 292/337
5,046,769 A 9/1991 Rimbey et al.
5,054,827 A 10/1991 Konchan et al.
5,066,054 A * 11/1991 Ingenhoven ..... 292/201
5,181,754 A * 1/1993 Shibata ..... 292/216
5,308,128 A 5/1994 Portelli et al.
5,348,357 A 9/1994 Konchan et al.
5,454,608 A 10/1995 Dzurko et al.
5,535,607 A * 7/1996 Dzurko et al. ..... 70/237
5,615,564 A * 4/1997 Inoue ..... 70/279.1
5,653,484 A * 8/1997 Brackmann et al. ..... 292/216
5,715,713 A * 2/1998 Aubry et al. ..... 70/277
5,794,992 A * 8/1998 Yoneyama ..... 292/216
5,833,282 A * 11/1998 Ikeda ..... 292/201
5,896,767 A * 4/1999 Gomi ..... 70/237
5,961,164 A 10/1999 Gomi
6,007,118 A 12/1999 Arabia, Jr. et al.
6,019,402 A 2/2000 Arabia, Jr. et al.
6,048,002 A 4/2000 Ohta et al.
6,050,620 A 4/2000 Rogers, Jr. et al.
6,059,328 A * 5/2000 Gomi ..... 292/216
6,065,316 A * 5/2000 Sato et al. ..... 70/264
6,102,453 A 8/2000 Cetnar
6,126,212 A 10/2000 Fujihara
6,168,215 B1 1/2001 Kodama et al.
6,267,420 B1 7/2001 Miyagawa
6,428,058 B1 8/2002 Graute
6,428,059 B2 8/2002 Kobayashi et al.

(Continued)

*Primary Examiner*—Carlos Lugo
(74) *Attorney, Agent, or Firm*—Clark Hill PLC

(57) ABSTRACT

A vehicle latch having a ratchet; a pawl, interacting with the ratchet; an outside release lever (66); a link (80) for selectively coupling the outside release lever (66) to the pawl; a lock link lever (116) for actuating the link (80) between an unlocked position, where the outside release lever (66) is kinematically coupled to the pawl, and a locked position, where the outside release lever (66) is not coupled to the pawl; and a key cylinder lever (120) for actuating the lock link lever (116). The key cylinder lever (120) has a lost motion connection with the lock link lever (116) so as to define a neutral position for a key cylinder.

6 Claims, 9 Drawing Sheets

U.S. PATENT DOCUMENTS

| | | | | |
|---|---|---|---|---|
| 6,435,575 | B1 | 8/2002 | Pajak et al. | |
| 6,517,128 | B2 | 2/2003 | Perkins et al. | |
| 6,540,271 | B1 | 4/2003 | Kalsi | |
| 6,554,328 | B2 | 4/2003 | Cetnar et al. | |
| 6,592,157 | B1 | 7/2003 | Spurr | |
| 6,601,883 | B1 | 8/2003 | Kalsi | |
| 6,607,222 | B2 | 8/2003 | Inoue | |
| 6,679,532 | B2 * | 1/2004 | Inoue | 292/216 |
| 6,695,362 | B2 | 2/2004 | Klueting et al. | |
| 6,705,649 | B1 | 3/2004 | Reddmann | |
| 7,036,855 | B2 * | 5/2006 | Lin et al. | 292/216 |
| 2001/0005080 | A1 | 6/2001 | Inoue | |
| 2001/0024040 | A1 | 9/2001 | Spurr | |
| 2001/0050483 | A1 | 12/2001 | Hanisch et al. | |
| 2002/0017792 | A1 | 2/2002 | Raffelsiefer et al. | |
| 2002/0074805 | A1 | 6/2002 | Perkins et al. | |
| 2002/0074806 | A1 | 6/2002 | Perkins et al. | |
| 2002/0105192 | A1 | 8/2002 | Perkins et al. | |
| 2003/0020285 | A1 | 1/2003 | Kluting et al. | |
| 2003/0094818 | A1 | 5/2003 | Tomaszewski et al. | |
| 2003/0155779 | A1 | 8/2003 | Belmond et al. | |
| 2003/0218340 | A1 | 11/2003 | Coleman et al. | |
| 2003/0222462 | A1 | 12/2003 | Bruce | |
| 2004/0007882 | A1 | 1/2004 | Arabia, Jr. et al. | |

* cited by examiner

VEHICLE LATCH WITH PARTIALLY DECOUPLED KEY CYLINDER LEVER

FIELD OF INVENTION

The invention generally relates to the field of vehicle latches.

BACKGROUND OF INVENTION

Vehicle latches typically have a key cylinder as an input. The key cylinder is usually coupled via a number of levers to the pawl, which releases the ratchet. The key cylinder is a vital input, and it would be useful from a control standpoint to know when the key cylinder has changed its orientation from a lock posture to an unlock posture.

SUMMARY OF INVENTION

The invention provides the desired function in a latch capable of disabling an outside release lever. According to one aspect of the invention, a vehicle latch is provided which includes a ratchet; a pawl, interacting with the ratchet; an outside release lever; a link for selectively coupling the outside release lever to the pawl; a lock link lever for actuating the link between an unlocked position, where the outside release lever is kinematically coupled to the pawl, and a locked position, where the outside release lever is not coupled to the pawl; and a key cylinder lever for actuating the lock link lever. The key cylinder lever has a lost motion connection with the lock link lever so as to define a neutral position for a key cylinder.

BRIEF DESCRIPTION OF DRAWINGS

A preferred embodiment of the invention will now be described, by way of example only, with reference to the attached drawings, wherein.

DETAILED DESCRIPTION OF PREFERRED EMBODIMENTS

Figure 1A:
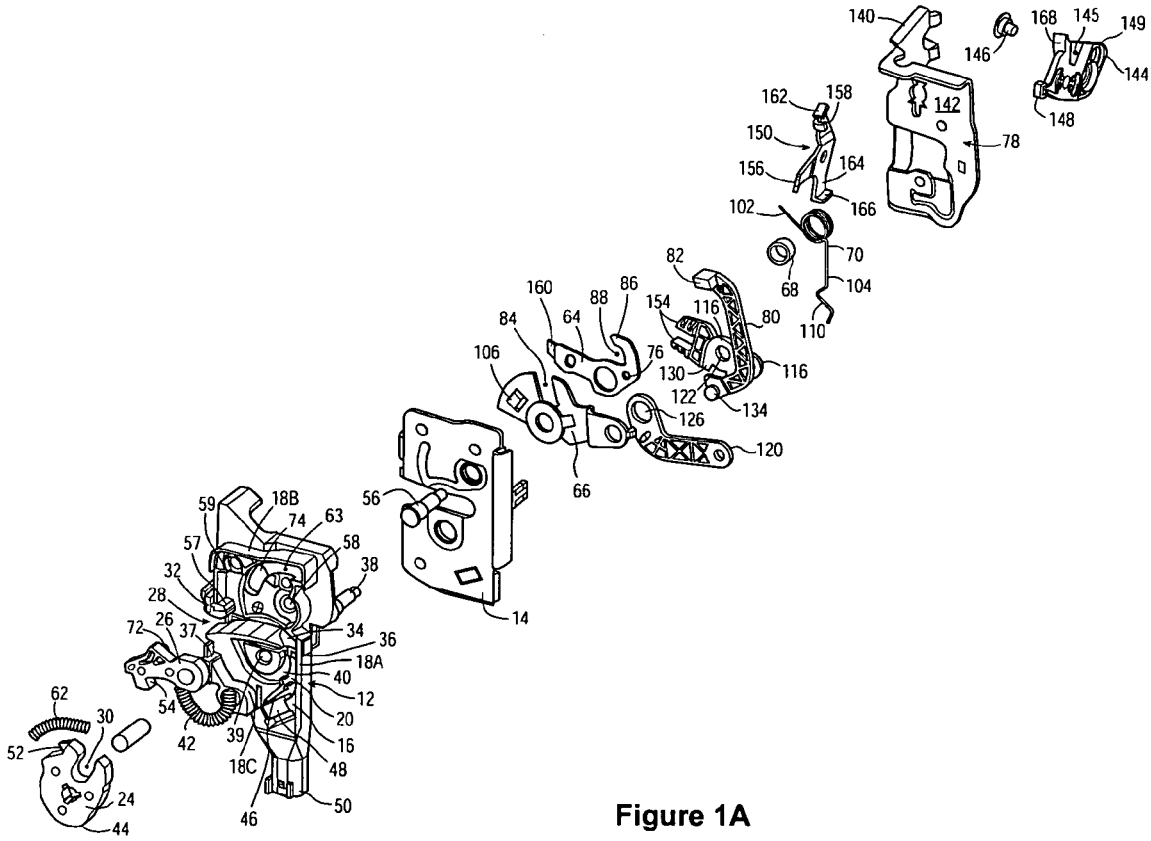
FIG. 1A is an exploded view of a latch according to the preferred embodiment.
Figure 1B:
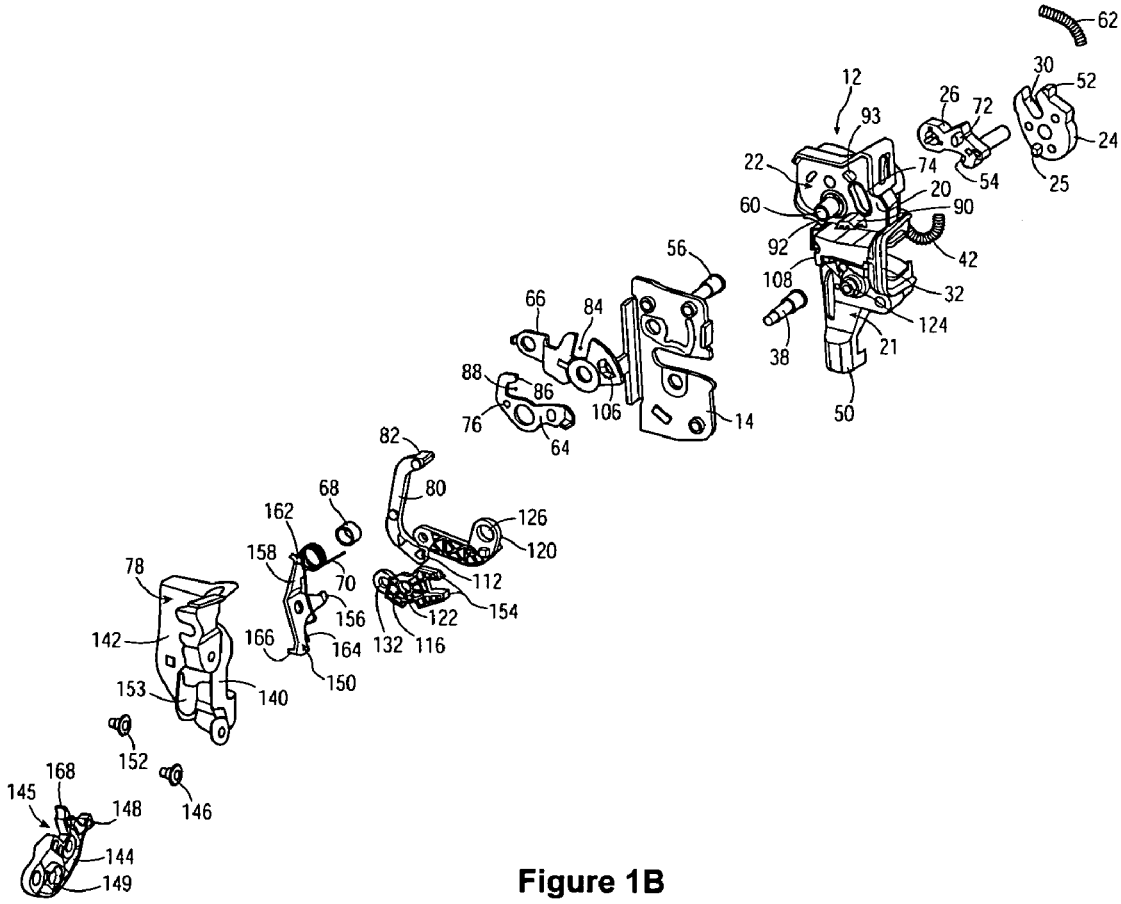
FIG. 1B is a reverse image view of FIG. 1A.

FIGS. 1A and 1B are perspective views of the latch 10 taken from reverse angles. Referring to FIGS. 1A, 1B, the latch includes a housing 12, preferably formed from a rigid thermoplastic material, having a substrate 20 and peripheral walls 18 which define a first cavity 16 (FIG. 1A) and, on the opposite side of the substrate 20, cavities 21 and 22 (FIG. 1B). A ratchet 24 and a pawl 26 are disposed in the cavity 16.

Figure 2:
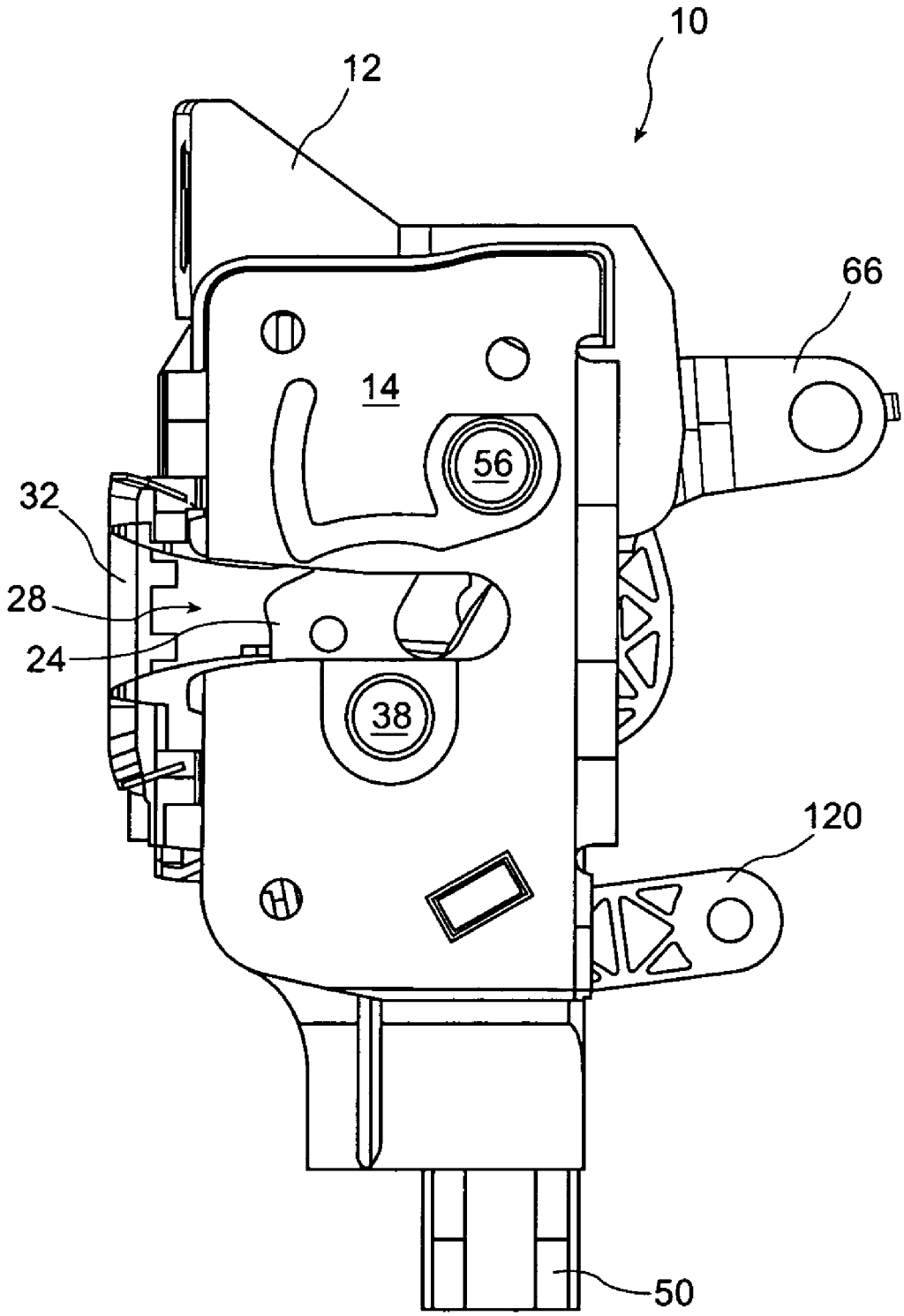
FIG. 2 is an elevation view of one side of the latch shown in FIGS. 1A & 1B.
Figure 3:
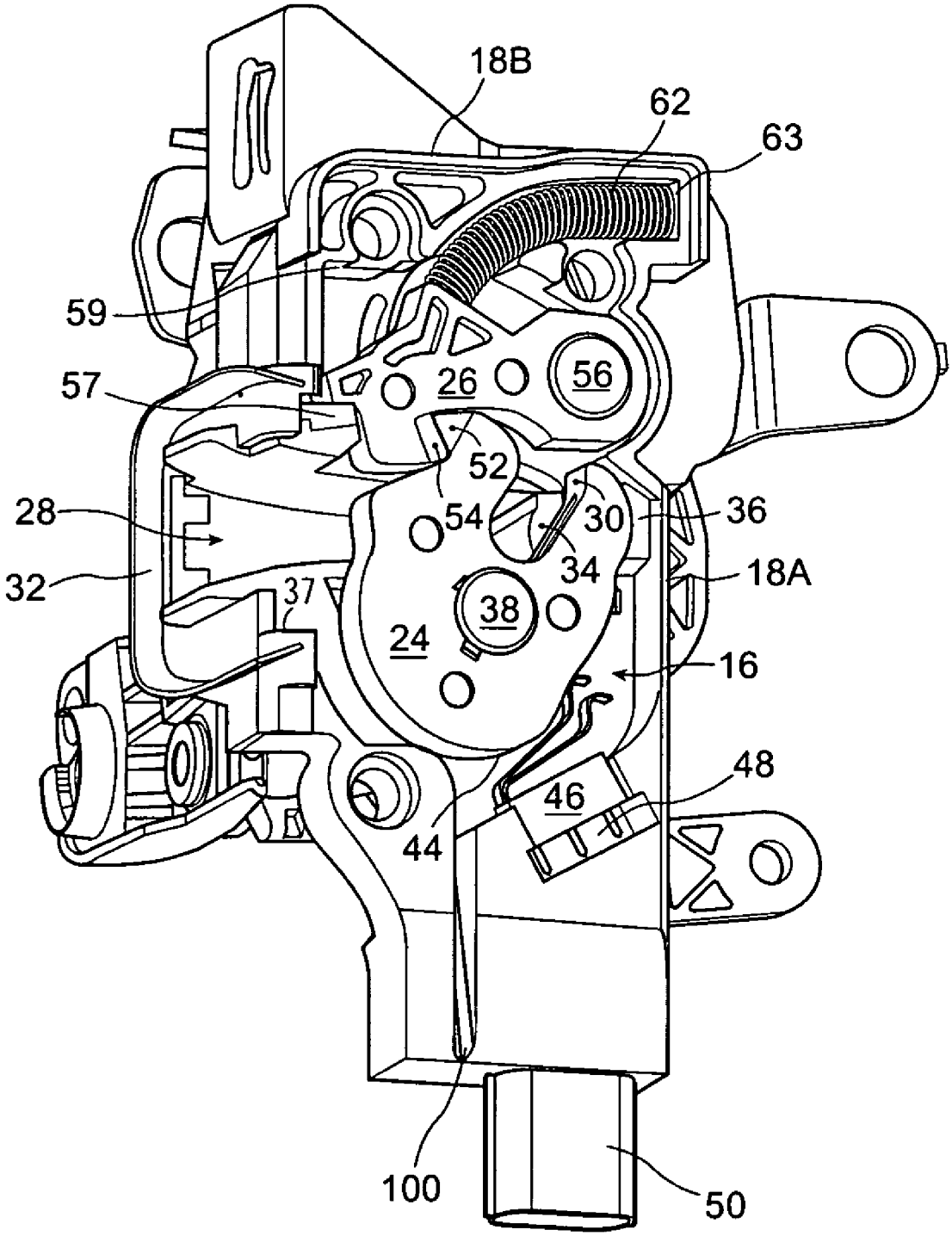
FIG. 3 is a perspective view of the latch shown in FIG. 2, with a cover plate removed.
Figure 4:
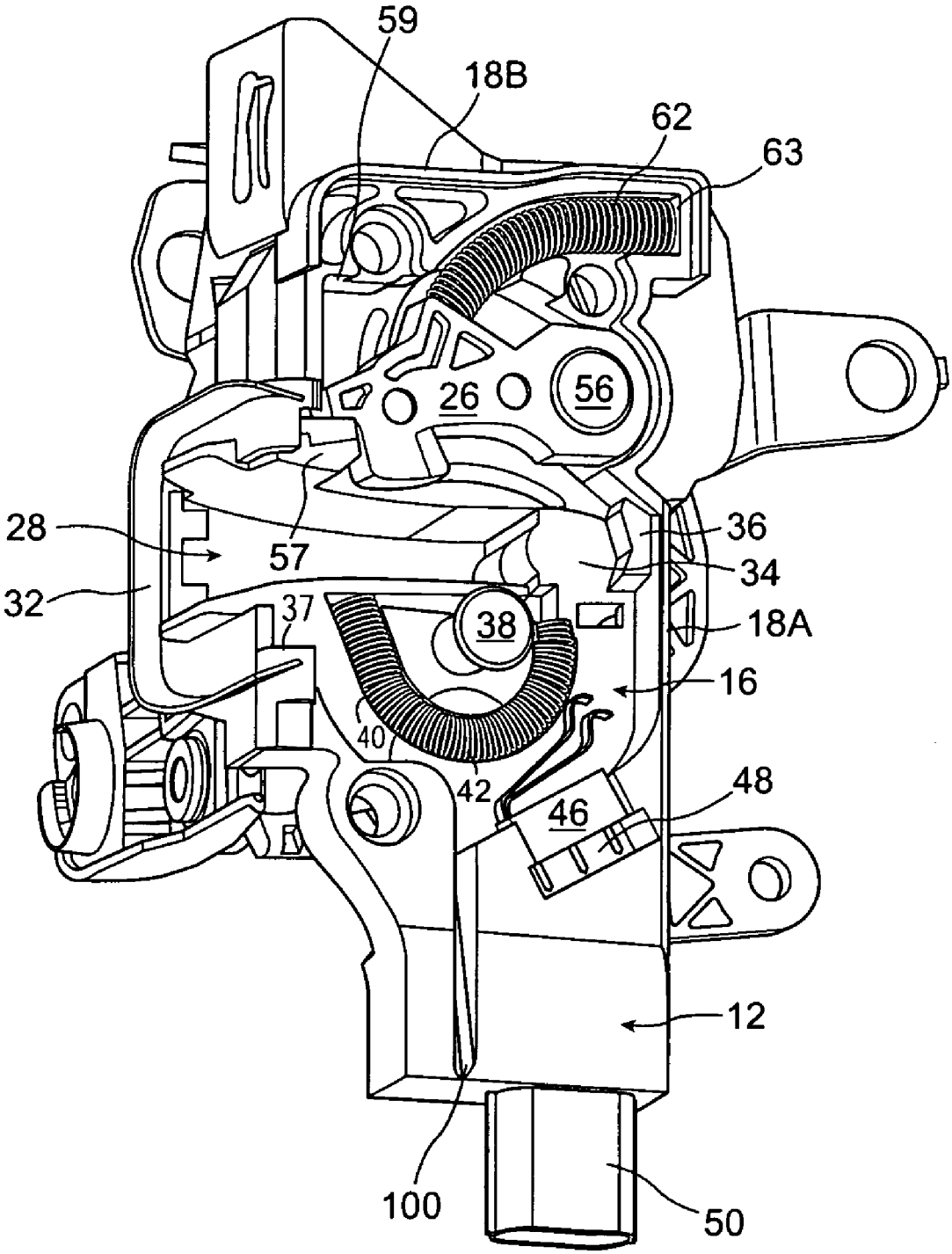
FIG. 4 shows the latch in the orientation of FIG. 3, with a variety of levers removed from view.

FIG. 2 shows a front end view of the latch 10, which includes a front faceplate 14 covering housing 12. FIG. 3 is a perspective view of the latch with the faceplate 14 removed, showing cavity 16 and the components installed therein, including the ratchet and pawl. FIG. 4 provides the same view, with the exception that ratchet 24 has been removed from the illustration. Referring additionally to FIGS. 2-4, a frusto-trapezoidal aperture 28, often referred to as a "fishmouth", bisects the substrate 20. The fishmouth is designed to receive a striker (not shown) which engages a hook 30 of the ratchet 24, as known in the art per se. A seal 32 is mounted to or otherwise integrally formed with the housing 12 at the open end of the fishmouth 28. The seal 32 is preferably formed from a flexible rubber material. An elastomeric or rubber bumper 34 is mounted at the apex end of the fishmouth 28, abutting peripheral wall 18A. The bumper 34 functions to receive and absorb the impact of the striker thus reducing the stresses on the latch and reducing noise. The bumper 34 includes a shoulder 36 which extends into cavity 16, adjacent peripheral wall 18A.

The ratchet 24 is pivotally mounted to substrate 20 via a pin 38 inserted into a hole 39 (FIG. 1A) in the substrate 20. The angular travel of the ratchet is delimited by the shoulder 36, which receives impact forces from the ratchet, and a wall 37 in the housing. A groove 40 (FIG. 1A & 4) is formed within the substrate 20 and a biasing spring 42 is installed therein in order to bias the ratchet 24 to an open position. The ratchet 24 has a tab 25 (FIG. 1B) which projects from the underside thereof to engage the spring 42. The ratchet 24 features a lip 44 (FIG. 3) which engages a leaf spring switch 46 mounted in recess 48 of housing 12. More particularly, as the ratchet 24 rotates from a closed position (as shown in FIG. 3) to the open position (rotating counterclockwise in FIG. 3) the lip 44 urges the leaf spring to the position shown in phantom lines in FIG. 3, thus changing the state of the switch. The switch 46 has a plurality of terminals which are attached to a wiring harness (not shown) that is disposed in and extends from a tubular construct 50 formed in the housing 12.

The pawl 26 is pivotally mounted to the housing 12 by a pin 56 which is inserted in an aperture 58 of substrate 20. The angular travel of the pawl 26 is delimited by an abutment 57 and a wall 59. A spring 62 is installed in a groove 63 formed in substrate 20 in order to bias the pawl 26.

The ratchet 24 and pawl 26 are preferably constructed out of metal but covered with a plastic material in order to reduce noise during operation. Certain portions subject to wear, such as shoulder 52 (FIG. 3) of ratchet 24 which abuts a shoulder 54 of the pawl 26 are not covered by plastic.

The housing 12 includes a channel 100 extending from the interior of cavity 16 to the exterior of housing 12. This channel provides a water outlet for the latch.

Figure 5:
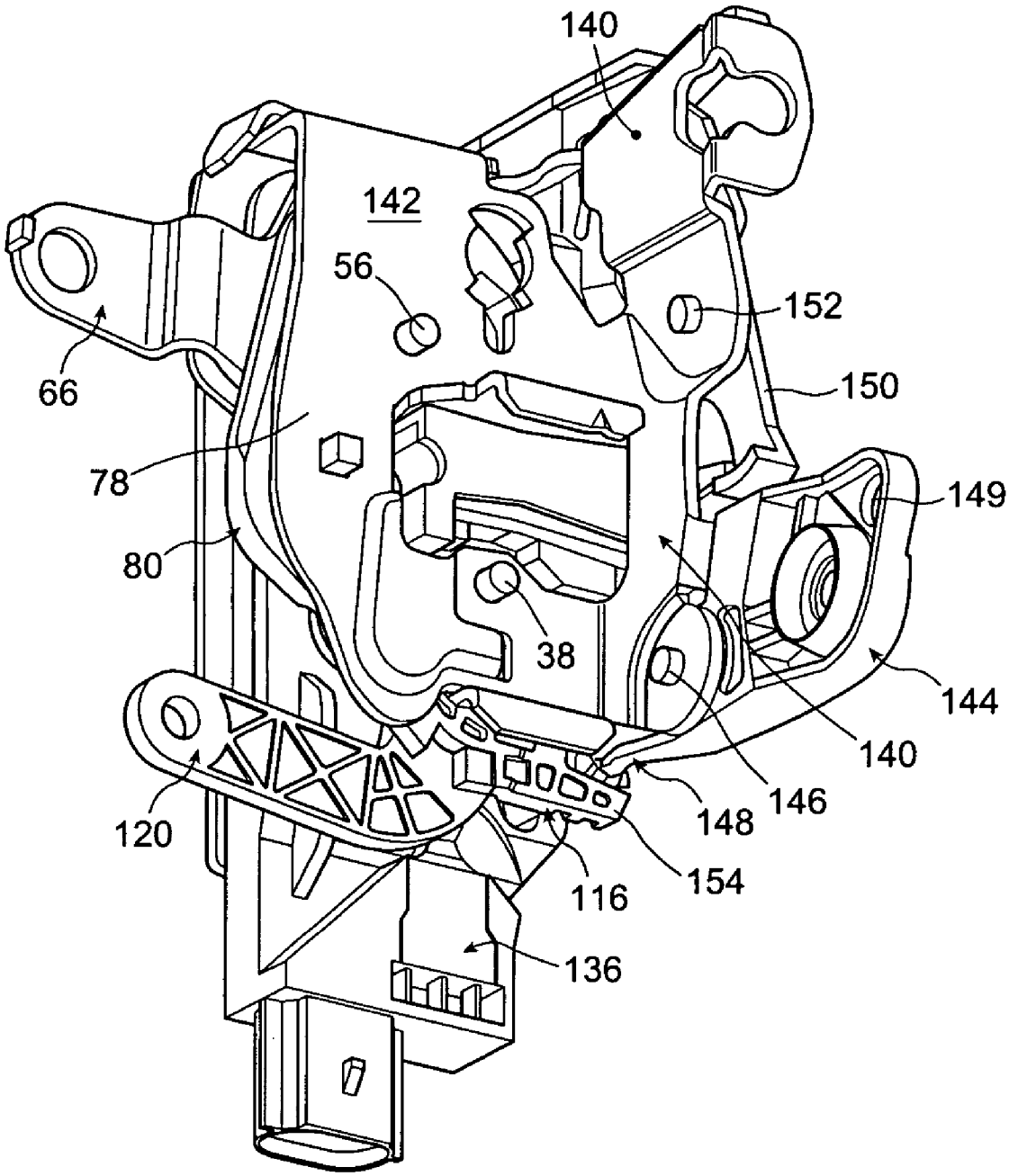
FIG. 5 is a perspective view of the latch showing the side opposite to that shown in FIG. 2.
Figure 6:
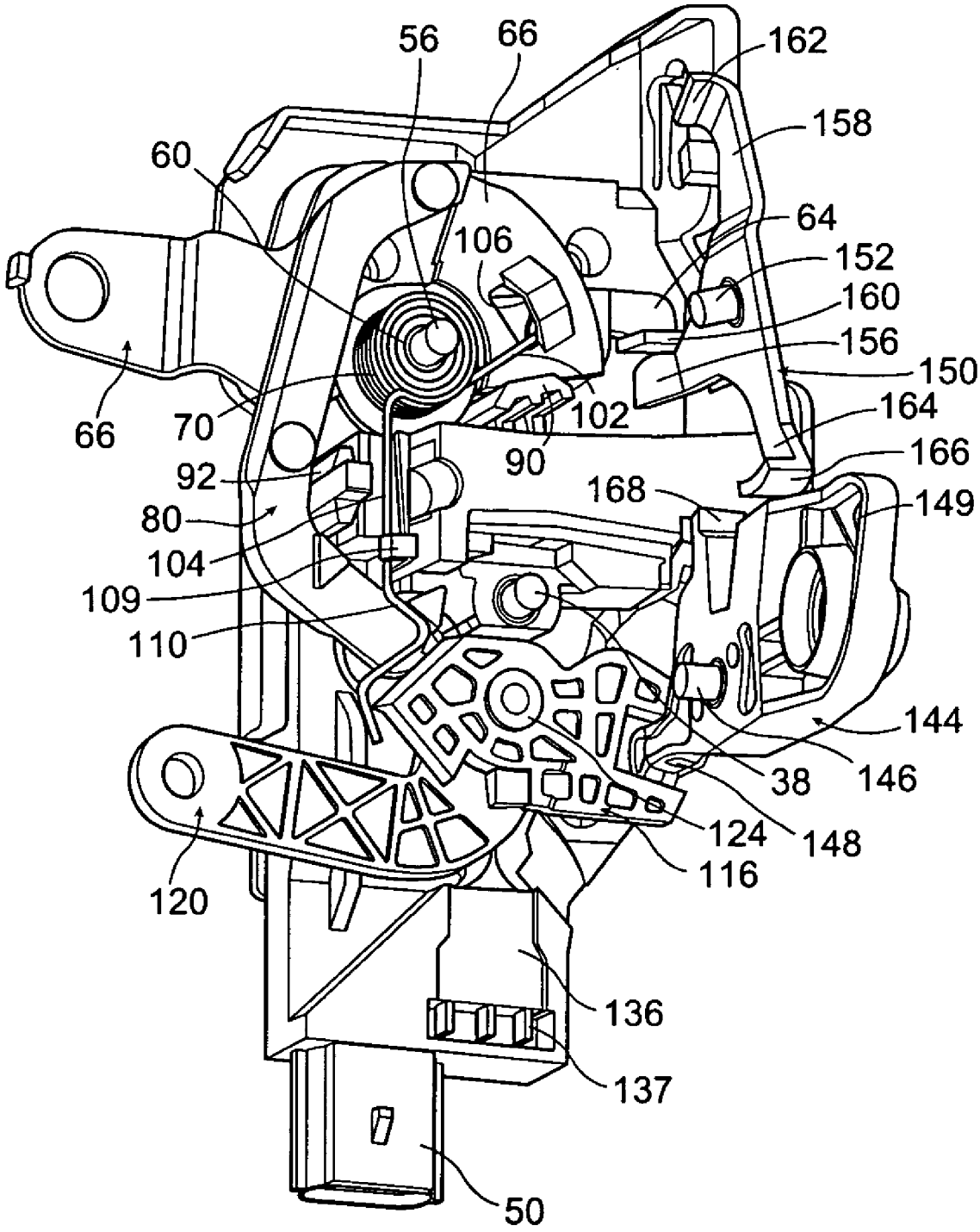
FIG. 6 shows the latch in the orientation of FIG. 5, with a cover plate removed from view.
Figure 7:
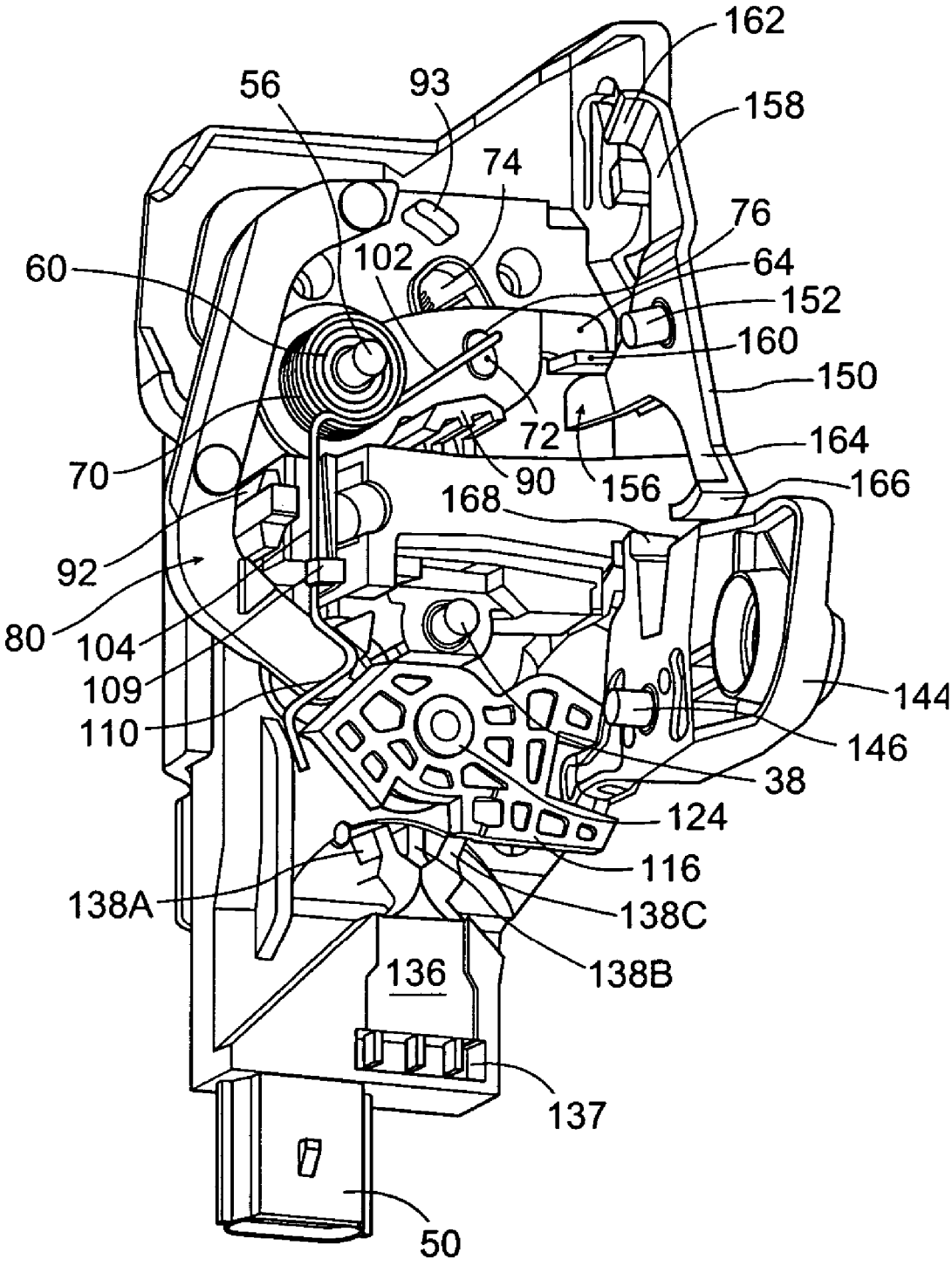
FIG. 7 shows the latch in the orientation of FIG. 6, with a variety of levers removed from view.

FIG. 5 shows a perspective rear end view of the latch 10. FIG. 6 is a perspective view of the latch with a rear cover plate 78 removed. FIG. 7 provides the same view, with the exception that an outside release lever 66, a key cylinder lever 120, and a bracket 140 are removed from the illustration.

Referring additionally to FIGS. 5-7, the substrate 20 on the opposite side of aperture 58 includes an integral tubular post 60 in cavity 22 (FIG. 1B) through which pin 56 extends. An auxiliary pawl lever 64 and an outside release lever 66 are pivotally mounted to the pin 56/post 60 in cavity 22. A capstan 68 is also mounted to the pin 56/post 60 and a toggle spring 70 is mounted over the capstan 68. The pins 38 and 56 are also used to mount the rear cover plate 78 to the housing 12.

The angular travel of the auxiliary pawl lever 64 is delimited by stops 90 and 93 on substrate 20. The angular travel of the outside release lever 66 is delimited by stops 90 and 92 on substrate 20.

As seen best in FIGS. 1A, 1B & 7, the auxiliary pawl lever 64 is kinematically coupled to the pawl 26 by a projection 72 which extends through a slot 74 in substrate 20 and seats in an aperture 76 of the auxiliary pawl lever 64. (The auxiliary pawl lever 64 therefore effectively functions as one with the pawl.) The outside release lever 66 is selectively kinematically coupled to the auxiliary pawl lever 64 by means of a slidable link 80 which has a depending tab 82 that slides in and along a slot 84 disposed in the outside release lever 66. The tab 82 slides between a first position, near the open end of the slot 84, and a second position, near the closed end of the slot 84. When the tab 82 is located in the first position adjacent the open end of the slot 84, rotation of the outside release lever 66 causes the tab 82 to engage abutment 86 of the auxiliary pawl lever 64 and thus cause lever 64, and correspondingly pawl 26, to rotate. This is the unlocked position. However, when the tab 82 is located in the second position adjacent the closed end of the slot 84, the tab 82 is positioned in a void 88 of auxiliary pawl lever 64 whereby rotation of the outside release lever 66 is not coupled to the auxiliary pawl lever 64. This is the locked position.

The toggle spring 70 biases the link 80 in either the first (unlocked) or second (locked) position. More particularly, the toggle spring 70 includes first and second linear end sections 102, 104. Linear section 102 is fitted into a notch 106 formed in the outside release lever 66. Linear section 104, which includes a triangular portion 110 abuts against wall 108 of housing 12 which includes a holding clip 109 for maintaining the spring in place. A triangular projection 112 of link 80 (FIG. 1B) rides against the outer portion of the triangular spring section 110. At the apex of the triangular section 110 the toggle spring 70 is compressed to a greater extent than at either of the bases of triangular section 110, thus biasing the link 80 into either the first or second position depending on which side of the apex the projection 112 of link 80 is located.

Figure 8:
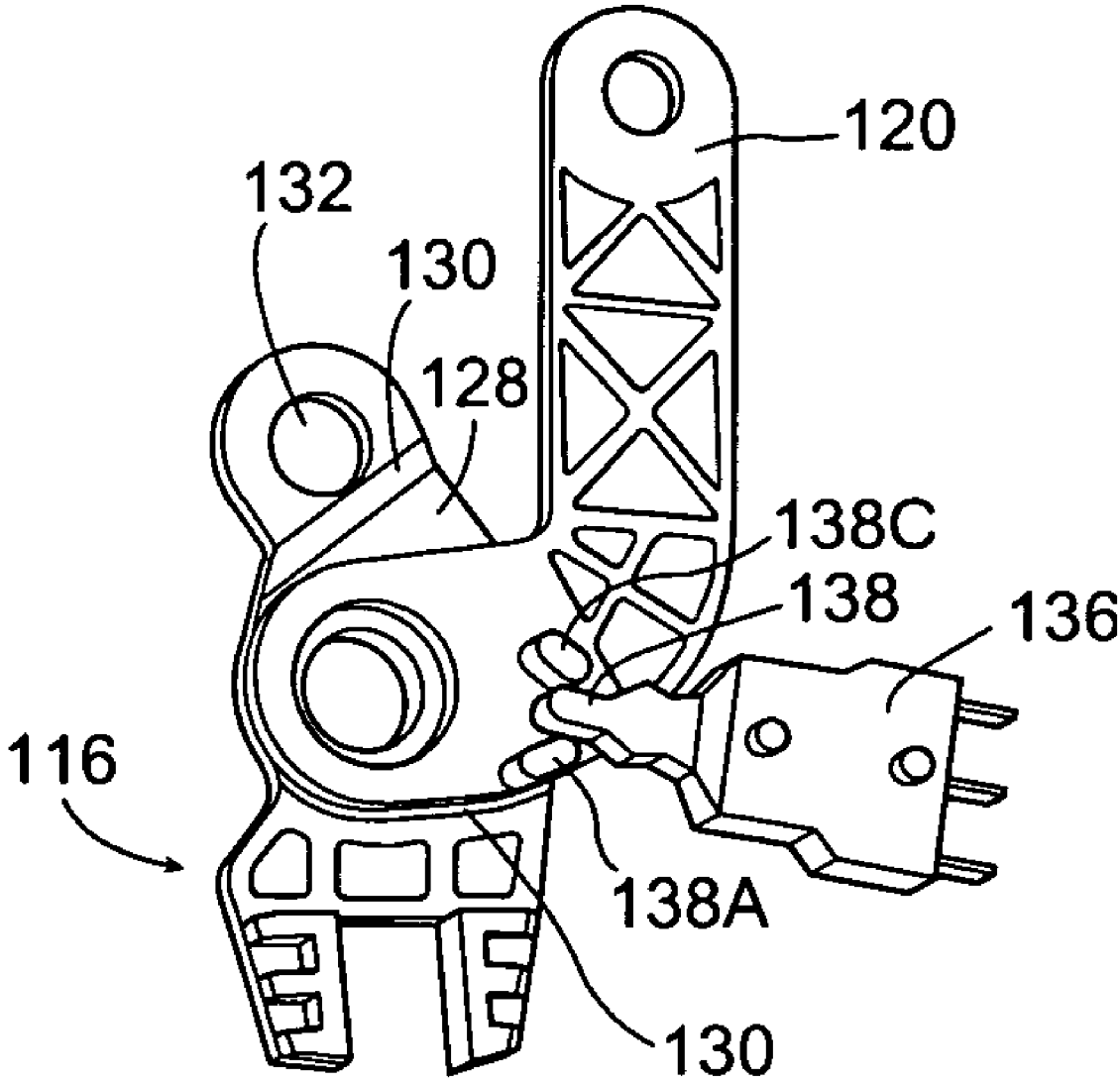
FIG. 8 is an isolated view of specific levers shown in FIG. 6.

The link 80 is actuated by a lock link lever 116 which, in turn, is actuated by a key cylinder lever 120 connectable to a key cylinder (not shown). More particularly, the lock link lever 116 is pivotally mounted at hole 122 to a post 124 integrally formed in cavity 21 of housing 12 and the key cylinder lever 120 is likewise pivotally mounted at hole 126 to the post 124. As seen best in the isolated elevation view of FIG. 8, the lock link lever 116 includes a shelf 128 with side ridges 130. The key cylinder lever 120 seats in the shelf 128 and has an angular freedom of motion of about 20 degrees ("lost motion") before the lever 120 engages one of the side ridges 130 and imparts rotational motion to the lock link lever 116. The lock link lever 116 includes an aperture 132 which receives a coupling projection 134 (FIG. 1A) depending from link 80, thus kinematically coupling link 80 to lock link lever 116 and, in turn, to key cylinder lever 120. Consequently, only a full rotation of key cylinder lever 120 causes link 80 to move between the locked and unlocked positions.

The key cylinder lever 120 engages a three-position rocker switch 136 having an input arm 138 mounted in a pocket 137 formed in housing 12. The switch 136 has a plurality of terminals connected to a wiring harness (not shown) installed in and extending from tubular construct 50. When the key cylinder lever 120 is at one end of its angular travel, it urges arm 138 to position 138A (shown in phantom). In the middle of its angular travel, during the portion of lost motion, the key cylinder lever urges arm 138 to second position 138B. At the opposite end of its angular travel, the key cylinder lever disengages from arm 138, which is biased to third position 138C (shown in phantom). In this manner, the three-position switch 136 is capable of indicating three positions of the key cylinder: neutral, unlock and lock, which information can be utilized in a variety of ways by control electronics. For example, the change from neutral to lock position may be monitored by a controller (not shown) to activate an alarm, and the change from lock to neutral position may be monitored to deactivate the alarm.

The key cylinder lever 120 and the auxiliary pawl lever 64 respectively interact with a lock lever 144 and an inside release lever 150. These levers 144 and 150 are mounted to a bracket 140 integrally formed with the rear cover plate 78 which is oriented substantially orthogonal to the main body 142 of plate 78. The inside lock lever 144 is pivotally mounted to bracket 140 via pin 146 and the inside release lever 150 is pivotally mounted to the bracket 140 via pin 152.

The inside lock lever 144 includes a leg 148 which engages a fork 154 of lock link lever 116, thus kinematically coupling lever 144 with link 80. The inside lock lever 144 may be rotated via a locking rod (not shown) coupled to aperture 149 and includes a rebate 145 defining, in conjunction with stop 153 of the wing 140, the angular travel of the lever 144.

This inside release lever 150 includes a foot 156 which abuts a projecting appendage 160 of the auxiliary pawl lever 64. The inside release lever 150 may be rotated via a cable (not shown) connected between pincers 162 of elongate member 158, thus causing the auxiliary pawl lever 64 to rotate and release the ratchet 24. Note also that the inside release lever 150 includes a second, opposing, elongate member 164 having a toe 166 for engaging a pedal 168 of the inside lock lever 144 when the latter is in the locked position such that lever 144 is moved to the unlocked position when the inside release lever 150 is actuated.

In, operation, the pawl 26 may be activated to release the ratchet 24 from the engaged position by actuating the inside release lever 150. As previously described, the foot 156 of inside release lever 150 urges the auxiliary pawl lever 64 via its appendage 160 which, in turn, rotates the pawl 26 via the projection and slot linkage 72 & 74. At the same time, toe 166 of the inside release lever 150 unlocks the inside lock lever 144 via pedal 168 which, in turn, urges the key cylinder lever 120, the lock link lever 116 and the lock link 80 to the unlocked position. Alternatively, if the link 80 is in the unlocked position, pawl 26 may be activated by the outside release lever 66 since link 80 couples lever 66 to the auxiliary pawl lever 64. In the event the inside lock lever 144 or the key cylinder lever 120 is positioned in the lock position, the lock link lever 116 is rotated to urge link 80 into the lock position whereby the outside release lever 66 is decoupled from the auxiliary pawl lever 64, thus disabling the use of the outside release lever in this position.

The invention claimed is:

1. A vehicle latch, comprising:

a ratchet;

a pawl, interacting with said ratchet;

an auxiliary pawl (64) operatively coupled to said pawl;

an outside release lever (66) including a slot (84) extending between an open end and a closed end;

a link (80) for selectively coupling said outside release lever (66) to said auxiliary pawl (64), said link (80) extending between a first end (82) and an opposing second end (134); and a lock link lever (116) coupled to said second end (134) of said link (80) for actuating said link (80) between an unlocked position, where said first end (82) is disposed in said slot (84) adjacent said open end whereby rotation of said outside release lever (66) causes said first end (82) to engage said auxiliary pawl (64) causing said auxiliary pawl (64) and said pawl to rotate, and a locked position, where said first end (82) is disposed in said slot (84) adjacent said closed end thereby decoupling said outside release lever (66) such that rotation of said outside release lever (66) does not cause said first end (82) to engage said auxiliary pawl (64) and said auxiliary lever (64) and said pawl do not rotate.

2. A latch according to claim 1, further comprising a key cylinder lever (120) for actuating said lock link lever (116), wherein said key cylinder lever (120) has a lost motion connection with said lock link lever (116) so as to define a neutral position for a key cylinder.

3. A latch according to claim 2, further comprising a housing and a three-position rocker switch (136) having an input arm (138) mounted in an internal pocket (137) of said housing, wherein said key cylinder lever (120) actuates said rocker switch so that said input arm is in a middle position when said key cylinder lever (120) is in its portion of lost motion relative to said lock link lever (116).

4. A latch according to claim 3, wherein said housing includes a channel (100) extending from the interior of said housing to the exterior thereof, thereby providing a water outlet.

5. A latch according to claim 4, wherein said link lock lever (116) includes a shelf (128) defined by a pair of spaced apart side ridges (130) and said key cylinder lever (120) seats in said shelf (128) and has an angular range of motion relative to said link lock lever (116) before engaging one of said side ridges (130).

6. A vehicle latch, comprising:

a ratchet;

a pawl, interacting with said ratchet;

an auxiliary pawl (64) operatively coupled to said pawl, said auxiliary pawl (64) including an abutment (86) and a void (88);

an outside release lever (66) including a slot (84) extending between an open end and a closed end;

a link (80) for selectively coupling said outside release lever (66) to said auxiliary pawl (64), said link (80) extending between an end having a tab (82) and an opposing end having a projection (134);

a lock link lever (116) coupled to said projection (134) of said link (80) for actuating said link (80) between an unlocked position where said tab (82) is in a first position disposed in said slot (84) adjacent said open end whereby rotation of said outside release lever (66) causes said tab (82) to engage said abutment (86) of said auxiliary pawl (64) causing said auxiliary pawl (64) and said pawl to rotate, and a locked position where said tab (82) is in a second position disposed in said slot (84) adjacent said closed end thereby decoupling said outside release lever (66) such that rotation of said outside release lever (66) causes said tab (82) to engage said void (88) of said auxiliary pawl (64) and said auxiliary pawl (64) and said pawl do not rotate; and a key cylinder lever (120) for actuating said lock link lever (116), wherein said key cylinder lever (120) has a lost motion connection with said lock link lever (116) 50 as to define a neutral position for a key cylinder.

* * * * *